United States Patent [19]

Colavecchio

[11] 4,339,738

[45] Jul. 13, 1982

[54] SINGLE POLE DOUBLE THROW THERMOSTATIC SWITCH

[75] Inventor: Robert J. Colavecchio, Johnston, R.I.

[73] Assignee: Elmwood Sensors Inc., Cranston, R.I.

[21] Appl. No.: 259,241

[22] Filed: Apr. 30, 1981

[51] Int. Cl.[3] ..... H01H 37/52

[52] U.S. Cl. ..... 337/354; 337/365

[58] Field of Search ..... 337/343, 354, 362, 364, 337/365

[56] References Cited

U.S. PATENT DOCUMENTS

| | | | |
|---|---|---|---|
| 3,878,499 | 4/1975 | Concin | 337/354 |
| 3,943,480 | 3/1976 | Schuitt | 337/354 |
| 4,295,114 | 10/1981 | Pohl | 337/354 |

*Primary Examiner*—George Harris

*Attorney, Agent, or Firm*—Salter & Michaelson

[57] ABSTRACT

A construction for a single pole double throw thermostatic switch of the type having a bimetallic disc which communicates with a resilient contact arm to alternatively effect electrical continuity between the arm and a pair of fixed contacts, and a method of assembling and adjusting the same. One of the fixed contacts comprises a bendable arm so that the gap between the fixed contacts is adjustable by bending the arm prior to final assembly of the switch. Because the gap is set prior to the final assembly of the switch, substantial increases in precision and reliability are realized since the contacts may be observed during setting thereof. Furthermore, the necessity for an external gap setting adjustment screw on the switch is eliminated.

8 Claims, 8 Drawing Figures

SINGLE POLE DOUBLE THROW THERMOSTATIC SWITCH

BACKGROUND AND SUMMARY OF THE INVENTION

The instant invention relates to a thermostatic switch construction and more particularly to a construction for a single pole double throw thermostatic switch of the type actuated by a bimetallic disc which flexes in response to a predetermined temperature change, and a method of assembling and adjusting the same.

Single pole double throw thermostatic switches have found wide use in many applications, particularly in appliances and the like where electrical continuity must be alternatively effected between a first terminal and second or third terminals in response to a predetermined temperature. Traditional constructions for switches of this general type have included a main switch body and a bimetallic disc mounted at one end thereof and which exerts a flexing action in response to a predetermined temperature change. A pair of spaced fixed contacts and a resilient contact arm are mounted in the main body with the resilient arm being normally biased to engagement with the first of said fixed contacts, but being movable to a point of engagement with the second of said contacts. Communication between the resilient arm and the bimetallic disc is provided by a transfer pin which travels in a bore within the main body and operates to move the resilient arm from a position of engagement with said first fixed contact to a position of engagement with the second fixed contact. In this manner electrical continuity is alternatively effected between a first external terminal electrically connected to the resilient contact arm and second or third external terminals electrically connected to said first and second fixed contacts respectively.

Obviously, the effectiveness of thermostatic switches of this general type depends on the reliability of the switch to alternatively provide complete electrical continuity between the respective pairs of external terminals in response to a predetermined temperature change. One of the constraining factors in this regard is the precise setting of the gap between the pairs of fixed contacts. Since the movement of the resilient contact arm is controlled by corresponding movement of the disc, the amount of travel of the resilient arm is generally constant. Therefore, in order to insure the proper switching action with the resilient arm, the fixed contacts must be precisely positioned so that complete electrical continuity is effected and interrupted alternatively between the fixed contacts.

Previously known thermostatic switch assemblies have included an external adjustment screw which is engageable with one of the fixed contacts in the switch to effect the proper setting of the gap after the switch has been completely assembled. However, since the gap in this type of switch must be set after the switch has been completely assembled, it is impossible to observe the interaction between the adjustment screw and the fixed contacts and hence the reliability of the finished switch may in some cases be lessened as a result of improper adjustment of the screw. Furthermore, since the adjustment of the gap between the contacts is effected with an adjustment screw (usually of self-tapping type screw) dirt and contaminants can enter the cavity in the switch assembly around the threads of the screw and in some cases may damage or contaminate the contacts and thereby detract from the degree of electrical continuity effected by the switch.

The instant invention relates to a novel switch construction and method of assembling the same wherein the gap between the fixed contacts within the cavity is set before the switch is completely assembled thereby provide a more reliable setting of the gap. Since the gap is set prior to the final assembly of the switch, the entire gap setting operation may be completely observed to assure proper setting. Furthermore, since the gap is set at an intermediate point in the assembly of the switch, the necessity for providing an external screw on the switch is eliminated allowing the entire switch assembly to be better sealed to prevent dirt and contaminants from entering the interior thereof.

Accordingly, it is an object of the instant invention to provide a bimetallic disc type single pole double throw thermostatic switch construction wherein the gap between the fixed contacts in the switch assembly is preset by bending one of said contacts prior to the final assembly of the switch.

Another object of the instant invention is to eliminate the necessity for incorporating an external adjustment screw in a single pole double throw thermostatic switch construction.

A still further object of the instant invention is to provide an effective method for setting the gap between the fixed contacts in a bimetallic disc type single pole double throw thermostatic switch.

A still further object of the instant invention is to provide a method of assembling a single pole double throw thermostatic switch wherein the gap between the fixed contacts is set prior to the completion of the assembly of the switch.

Other objects, features and advantages of the invention shall become apparent as the description thereof proceeds when considered in connection with the accompanying illustrative drawings.

DESCRIPTION OF THE DRAWING

In the drawings which illustrates the best mode presently contemplated for carrying out the present invention.

DESCRIPTION OF THE INVENTION

Figure 1:
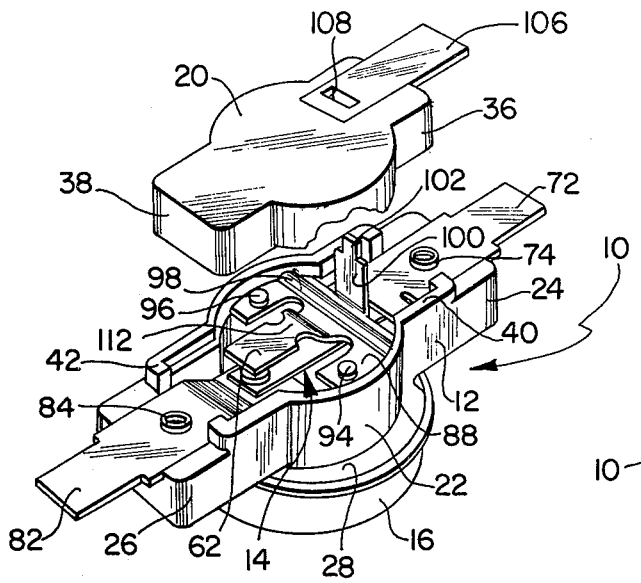
FIG. 1 is an exploded perspective view of the single pole double throw thermostatic switch of the instant invention.
Figure 2:
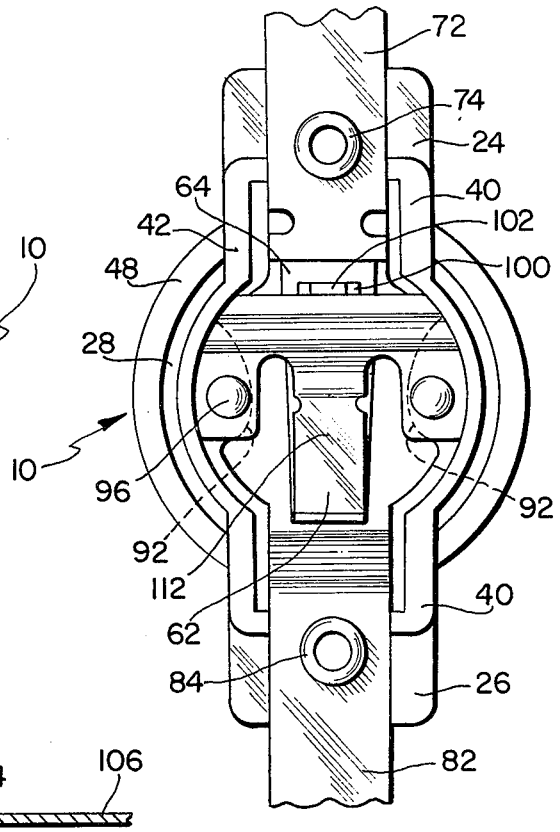
FIG. 2 is a top plan view of the main portion of the switch prior to the attachment of the cover thereto particularly illustrating the interior configuration of the switching components.

Referring now to the drawings, a bimetallic disc type single pole double throw thermostatic switch of the instant invention is illustrated in FIGS. 1 through 4 generally indicated at 10. As will be noted, the switch 10 comprises a main body 12 which houses a switching assembly generally indicated at 14 and has a cap 16 containing a bimetallic disc 18 therein. A transfer pin 19 within the main body 14 provides communication between the disc 18 and the switching assembly 14. A secondary body or cover 20 is attached to the main body 12 and and covers the switching assembly 14.

Figure 3:
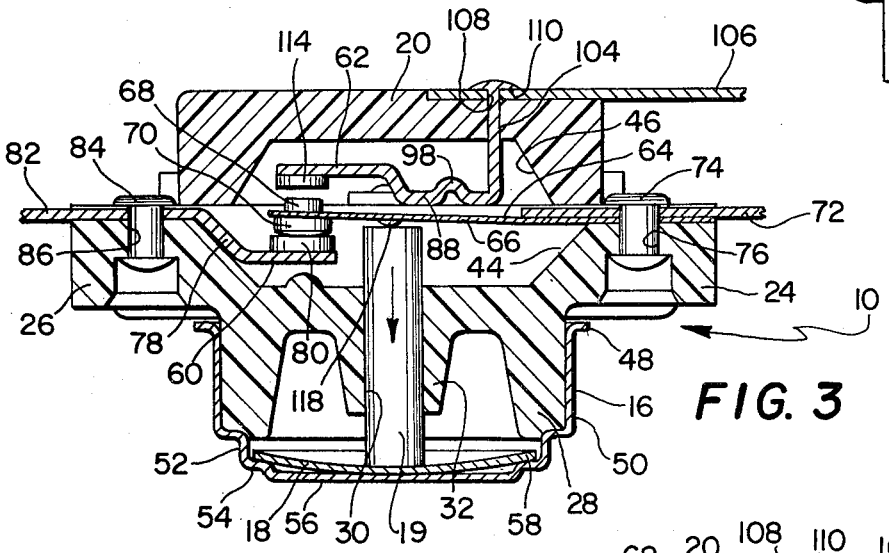
FIG. 3 is a side sectional view of a thermostatic switch of the instant invention with the bimetallic disc flexed downwardly.
Figure 4:
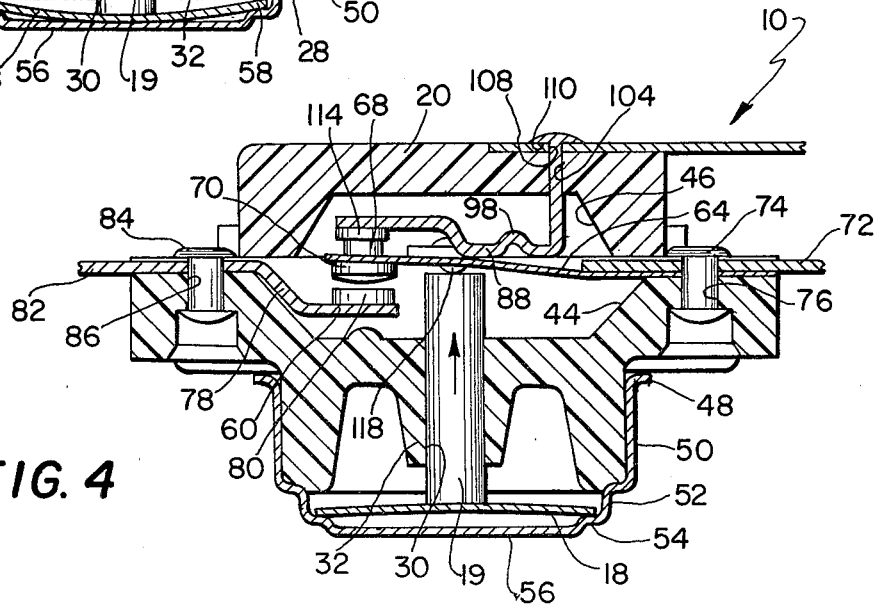
FIG. 4 is a similar view illustrating the positions of the switching elements with the bimetallic disc flexed upwardly.
Figure 5:
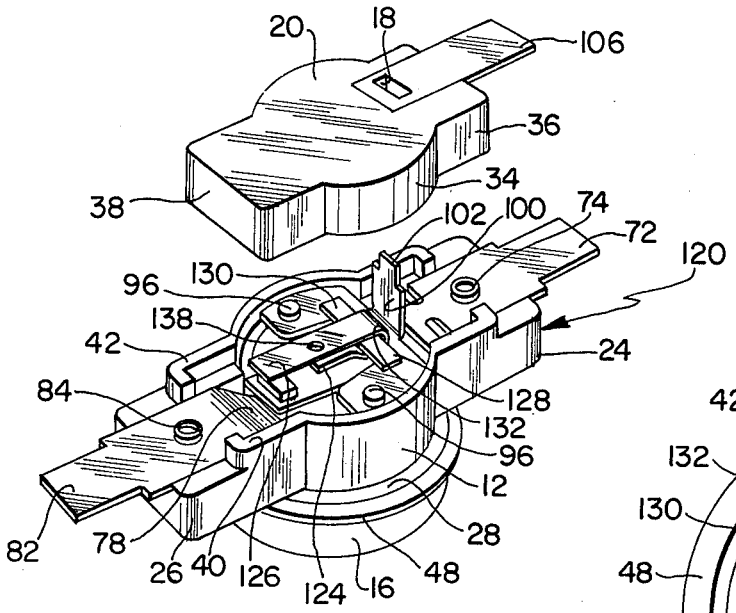
FIG. 5 is an exploded perspective view of a second embodiment of the switch of the instant invention.
Figure 6:
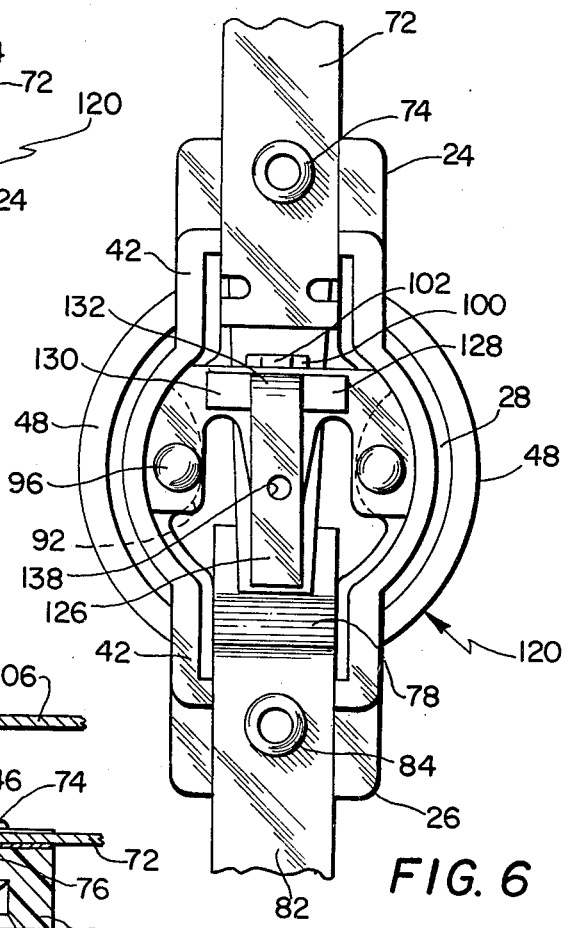
FIG. 6 is a top plan view of the main portion thereof.
Figure 7:
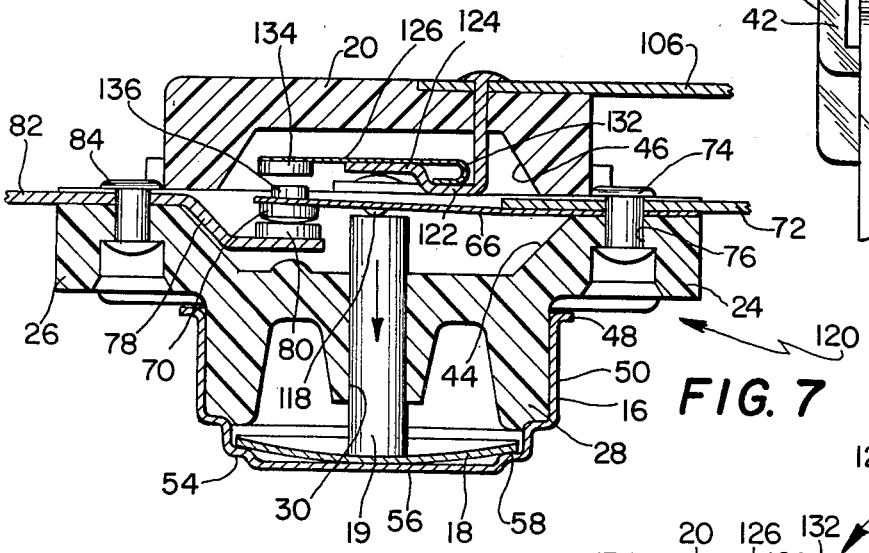
FIG. 7 is a side sectional view of the second embodiment of the switch with the bimetallic disc flexed downwardly.
Figure 8:
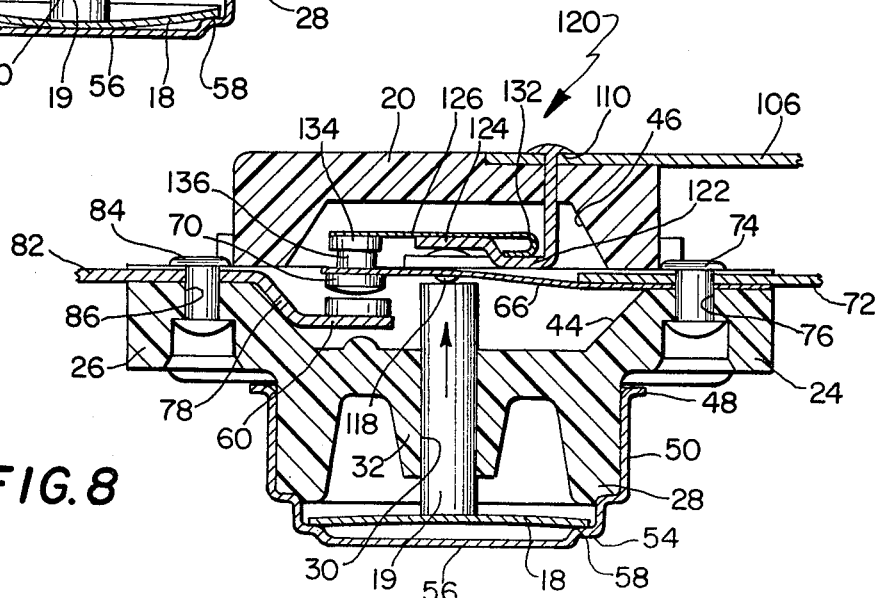
FIG. 8 is a similar view illustrating the positions of the switching components with the bimetallic disc flexed upwardly.

The configuration of the main body 12, which is preferably made of a non-conductive phenolic material, is particularly illustrated in FIGS. 1, 3 and 4. As will be noted, the main body 12 has a generally cylindrical main portion 22 with a pair of outward projections 24 and 26, and an enlarged cylindrical skirt portion 28. A longitudinal bore 30 extends substantially axially through the main body 12 with a boss 32 being formed in said body 12 to further extend the bore 30. The cover 20, which is also preferably made of a non-conductive phenolic material, is provided also with a cylindrical main portion 34 with projections 36 and 38 extending owtwardly therefrom. As will be noted particularly from FIG. 1, the main body 12 is provided with oppositely disposed upper peripheral rims 40 and 42, terminating substantially at the midpoint of projections 24, 26. Disposed interiorly of the rims 40 and 42 is a main cavity 44 in the body 12 and a similar cavity 46 is provided in the cover 20. The cover 20 is, as will be noted, receivable within the rims 40 and 42 whereby the main body 12 and the secondary body 20 define an inner chamber made up of cavities 44, 46 which inner chamber houses the assembly 14.

The cap 16 is disposed at the lower end of the assembly 10 providing the means for retaining and positioning the bimetallic disc 18. As will be noted, the cap 16 has an upper peripheral flange 48 and a side wall portion 50 which receives skirt portion 28 of the body 12 to effect the attachment of the cap 16 thereto. The cap 16 is further formed with a reduced wall portion 52 having a shoulder portion 54 to support and position the disc 18. The cap 16 further extends downwardly and inwardly from the shoulder portion 54 providing a bottom portion 56 which substantially covers and seals the bottom end of the switch 10. The bimetallic disc 18 is substantially circular and is made of two dissimilar metals having different thermal expansion characteristics whereby the disc 18 is capable of exerting a flexing action upon exposure to a predetermined temperature change. As will be noted, the disc 18 is positioned on the shoulder portion 54 with the perimetric portions of the disc 18 engaging the shoulder portion 54 as at 58.

The switching assembly 14 comprises a fixed contact 60, a bendable fixed contact arm 62 and a resilient contact arm 64. The resilient arm 64 comprises a downwardly biased resilient member 66, which is made of any suitable resilient conductive material extends diametrically across the interior chamber in the switch 10 and has upper and lower contact elements 68 and 70, respectively, secured adjacent the end thereof. The opposite end of the member 66 extends outwardly a distance along the upper surface of the projection 24 and engages terminal blade 72 to provide electrical continuity between the arm 64 and the exterior of the switch 10. The terminal 72 and the arm 64 are secured to the projection 24 by any convenient means such as a rivet 74 which extends through a hole 76 in the projection 24. The fixed contact 60 comprises a rigid member 78 which is made of a suitable conductive material and extends downwardly and inwardly having a contact element 80 on the upper surface thereof adjacent its extremity. The outer end of the member 78 defines a terminal blade 82 which extends outwardly from the projection 26, and the member 78 is secured to the projection 26 with a rivet 84 extending through a hole 86.

The bendable fixed contact arm 62 is disposed in the assembly 14 spaced slightly upwardly above the fixed contact 60 and the element 80. The arm 62 is preferably made of brass since it must be both conductive and relatively ductile and extends integrally from a base 88. A pair of inwardly extending projections 90 and 92 are provided in the cavity 44 and provide means for supporting and positioning the base 88 in the body 12 with said base 88 being secured to the projections 90 and 92 with rivets 94 and 96, respectively. The base 88 includes a transverse strengthening rib 98 and an inwardly extending tab 100 having a terminal portion 102 of reduced size. As will be further noted, the secondary body or cover 20 has a slot 104 of substantially rectangular section extending downwardly therethrough which receives the tab 100. A third terminal blade 106 having a substantially rectangular slot 108 which is in registry with the slot 104 extends outwardly from the body 20. Accordingly, electrical continuity is effected between the arm 62 and the third terminal 106 through the tab 100 and in this connection the reduced portion 102 may be twisted, bent or peened to effect securement between tab 100, terminal 106 and cover 20, as at 110. The arm 62, as will be noted, has a reduced tongue portion 112 which is provided to facilitate the bending thereof to adjust its position relative to the contact element 80. Tongue 112 extends transversely across the interior portion of the switch 10 and has a contact element 114 secured to the under surface thereof at its terminal end, adjacent to but spaced from the element 80.

The transfer pin 19, constructed of any suitable electrically insulating material provides communication between the disc 18 and the arm 64, said pin being slidingly positioned therebetween within the bore 30 with a cam button 118 being provided on the bottom surface of the arm 64 in engagement with the pin 19. As will be noted from FIG. 3, the pin 19 is dimensioned so that when the disc 18 is in its downwardly flexed position, the contact element 70 is biased into engagement with contact element 80, with the button 118 resting on the upper end of the pin 19. When the switch 10 is exposed to a predetermined temperature change, the disc 18 flexes upwardly to the position illustrated in FIG. 4, and this upward movement is communicated through the pin 19 to the resilient arm 64 whereby the disengagement of the element 70 from the element 80 is effected and the engagement to the contact element 68 with the contact element 114 is effected. It is obvious that since the disc 18 flexes only a small amount, the distance that the pin 19 travels is relatively small and hence the distance that the resilient arm 64 and the elements 68 and 70 travel is also relatively small. In order for the switch 10 to properly effect the switching function, electrical continuity must be alternatively effected between the terminal 72 and either the terminal 82 or the terminal 106. To accomplish this, the arm 64 must be in light pressurized engagement with the appropriate contact element and must be completely disengaged from the other fixed element. Therefore, the spacing or gap between the elements 80 and 114 is particularly critical. By providing a bendable contact arm 62, this gap can be set with precision prior to positioning the cover over the switching assembly 14. As a result, the total gap setting operation may be fully observed and any misalignment or improper setting may be compensated for prior to final assembly of the switch. Furthermore, by setting the gap in this manner, as opposed to providing an external adjustment screw which is engageable with one of the fixed contacts, the chamber defined by the cavities 46 and 98 may be substantially completely sealed to prevent contaminants from entering said chamber and detracting from the effectiveness of the switching assembly.

An alternate form of the single pole double throw thermostatic switch assembly of the instant invention is illustrated in FIGS. 5 through 8 of the drawings and is generally indicated at 120. As will be noted, the primary difference between the switch 120 and the switch 10 is the configuration of the bendable fixed contact arm. In the switch 120, the bendable fixed contact arm includes a base 122 having an upwardly extending tab 100 terminating in a reduced portion 102. However, instead of having an integral bendable fixed contact arm extending substantially transversely across the inner portion of the assembly 120, a bendable fixed contact stem 124 is provided extending a distance from the base 122 and a resilient contact arm 126 having a pair of outwardly extending leaves 128 and 130 attached to the base 122 extends transversely across the inner portion of the switch 120 to a point adjacent to the fixed contact 60. As will be noted, the resilient arm 126 extends from the leaves 128 and 130 doubling back on itself as at 132 to provide a resilient biasing for the arm 126. Preferably, the arm 126 is slightly downwardly biased into engagement with the stem 124, and a contact element 134 is provided on the bottom surface of the arm 126 adjacent to the terminal end thereof with a similar element 136 being provided on the upper surface of the resilient arm 64. It is obvious that since the arm 126 is resilient, it cannot easily be bent to reliably effect the proper setting of the gap between the elements 134 and 80. However, since the arm 126 is downwardly biased into engagement with the stem 124, the arm 126 tends to follow the stem 124 when it is bent downwardly. As a result, precision setting of the gap between the points 130 and 80 may be easily effected simply by bending the stem 124 downwardly to the proper position and in this connection a hole 138 is provided in the arm 126 to facilitate the bending of the stem 124.

Either of the switches 120 or 10 may be simply and easily adjusted in accordance with the instant invention. In order to effect the proper setting of the gap, the disc 18 is flexed upwardly preferably by exposing it to the proper predetermined temperature change. This causes the resilient arm 64 to move upwardly to its uppermost position. The electrical continuity between the terminals 72 and 106 is then measured and observed as the arm 62 (or the stem 124 in the case of the switch 120) is bent downwardly. The arm 62 (or the stem 124) is bent downwardly until complete continuity between the terminals 72 and 106 is effected. A slight additional amount of bending may be desirable due to the slight resiliency of the brass or other metal used in the construction of the arm but preferably the arm material is selected for its ability to retain any desired bend. Subsequent to the final adjustments of the gap, the secondary body or cover 20 is positioned on the main body 12 within the rims 40 and 42 and is secured to the body 12 and the rims 40 and 42 with suitable adhesives and/or sealants to effect a sealing of the interior chamber in the assembly. At the same time, reduced end 102 of tab 100 will extend through slots 104 and 108, after which it is peened or otherwise distorted to effect securement of terminal blade 106 to the switch and at the same time establish electrical continuity between the blade 106 and the bendable contact arm 62 or 124.

It is seen therefore that the instant invention provides an effective single pole double throw bimetallic disc thermostatic switch construction which is substantially more reliable than the constructions of the prior art. Furthermore, the method of assembling the switch has particular advantages over previously known methods in that it permits observation of the switching elements while adjusting the fixed contacts, thereby providing a more reliable and precise method of adjusting said gap.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A single pole double throw thermostatic switch assembly comprising:

a. a main switch body made of a non-conductive material having an open cavity therein and an opening therethrough in communication with said cavity;

b. a secondary switch body also made of a non-conductive material and having an open cavity therein, said secondary body being mounted on said main body with the cavities in said main and secondary bodies defining an open interior chamber in said assembly;

c. first, second and third electrical terminal means mounted on the exterior of said assembly;

d. a fixed contact mounted within said cavity and electrically connected to said second terminal means;

e. a bendable fixed contact arm mounted within said cavity with a portion of said arm being adjacent to but spaced above said fixed contact, said bendable contact arm being electrically connected to said third terminal means;

f. a resilient contact arm mounted within said cavity electrically connected to said first terminal means, a portion of said resilient arm being interposed between said fixed contact arm and said fixed contact with said resilient arm being normally spaced from said bendable arm and biased to engagement with said fixed contact but being movable to an alternative position of spaced disengagement from said fixed contact and engagement with said bendable fixed contact arm to alternatively effect electrical continuity between said first terminal means and said second or third terminal means;

g. a bimetallic disc responsive to a predetermined temperature change for exerting a flexing action disposed at the bottom end of said assembly adjacent to said opening;

h. means for mounting said disc at said bottom end without restricting the central portions thereof to permit the unrestricted flexing of said disc; and i. means communicating with said disc for alternatively effecting the engagement of said resilient arm with said fixed contact or said bendable fixed contact arm in response to said flexing action to thereby effect said alternative electrical continuity.

2. In the device of claim 1, said bendable arm being brass.

3. In the device of claim 1, said bendable fixed contact arm comprising:

a. a bendable fixed contact arm stem portion electrically connected to said third terminal means; and b. a downwardly biased resilient terminal arm mounted within said assembly above said stem portion and in engagement therewith as a result of its downward biasing, said terminal arm extending a distance across said assembly to a point adjacent to but spaced from said fixed contact, said resilient arm being engageable with said terminal arm to effect continuity between said first and third terminal means.

4. A method of assembling and adjusting a single pole double throw thermostatic switch of the type having a main switch body and a bimetallic disc capable of exerting a flexing action in response to a predetermined temperature change and which communicates through a transfer pin with a resilient contact arm which is electrically connected to a first external terminal in said body to effect the engagement of said arm alternatively with a fixed contact or a bendable fixed contact arm mounted on said main body and electrically connected to second and third electrical terminals thereon respectively to thereby effect electrical continuity alternatively between said first terminal and said second or third terminals comprising:

a. assembling with said main body, said first, second and third terminals, said disc, said pin, said fixed contact, said resilient arm, and said bendable arm;

b. flexing said disc to effect the spaced disengagement of said resilient arm from said fixed contact to thereby interrupt electrical continuity between said first and second terminals;

c. bending said bendable arm to effect the engagement thereof with said resilient arm to thereby effect electrical continuity between said first terminal and said third terminal; and d. securing a secondary switch body to said main body covering said fixed contact said resilient arm and said bendable arm;

5. The method of claim 4, further comprising the step of measuring the electrical continuity between said first and third terminals during the bending of said bendable arm to determine the point where complete electrical continuity is first established between said first and third terminals, said arm being bent substantially to said point.

6. A single pole double throw thermostatic switch assembly comprising a substantially hollow main switch body of electrically insulating material, lower and upper fixed contacts secured to said body in spaced overlying relation, a movable arm secured to said body and having contact means interposed between said fixed contact means biasing said arm so that said contact means is normally in engagement with said lower fixed contact, bimetallic means carried by said body and operatively engaged with said arm whereby flexing of said bimetallic means in response to a predetermined temperature change causes said arm to move from its position of engagement with said lower fixed contact to a position of engagement with said upper fixed contact, said upper fixed contact comprising a base portion mounted to said body, a portion extending upwardly from said base and merging with an elongate laterally extending arm having a contact element on its under surface adjacent its free end, the point of merger between said upward portion and said elongate arm defining a fold line whereby said elongate arm may be bent about said fold line to effect proper spacing between said upper and lower contacts.

7. The switch of claim 6 further characterized in that said upper contact base portion is provided with an upwardly extending tab, and a cover on said body, an external terminal blade mounted on said cover, said cover and said blade having aligned slots through which said tab extends, said tab being distorted at its upper end to secure said blade, cover and body in assembled relation.

8. In the switch of claims 6 or 7, said elongate arm having resilient means connected thereto, said resilient means extending beyond the end of said arm, said contact element being mounted on the underside of said resilient means adjacent the end thereof.

* * * * *

UNITED STATES PATENT AND TRADEMARK OFFICE

CERTIFICATE OF CORRECTION

PATENT NO. : 4,339,738

DATED : July 13, 1982

INVENTOR(S) : Robert J. Colavecchio

It is certified that error appears in the above-identified patent and that said Letters Patent is hereby corrected as shown below:

| | |
|---|---|
| Col 3 | Line 10, change "14" to --12--; |
| Col 4 | Line 22, change "inwardly" to --upwardly--; |
| Col 5 | Lines 60-61, change "terminals" to --terminal--; change "106" to --tab 100--; |
| | Line 65, change "terminals" to --terminal--; change "106" to --tab 100--; |
| Col 6 | Lines 47, 51 and 55, insert the words "main body" before the word "cavity". |

Signed and Sealed this

*Nineteenth* Day of *February 1985*

[SEAL]

*Attest:*

DONALD J. QUIGG

*Attesting Officer* *Acting Commissioner of Patents and Trademarks*